United States Patent [19]

Hofman

[11] 4,030,924

[45] June 21, 1977

[54] METHOD OF PRODUCING PHOTOGRAPHIC IMAGES

[75] Inventor: Emiel Alexander Hofman, Mortsel, Belgium

[73] Assignee: AGFA-GEVAERT N.V., Mortsel, Belgium

[22] Filed: Oct. 29, 1975

[21] Appl. No.: 626,766

Related U.S. Application Data

[63] Continuation of Ser. No. 429,631, Dec. 28, 1973, abandoned.

[30] Foreign Application Priority Data

Oct. 11, 1967 United Kingdom ..... 46444/67

[52] U.S. Cl. ..... 96/61 R; 96/50 R; 96/95

[51] Int. Cl.[2] ..... G03C 5/26; G03C 5/38; G03C 1/06; G03C 1/48

[58] Field of Search ..... 96/50, 48 QP, 61, 95

[56] References Cited

UNITED STATES PATENTS

| | | | |
|---|---|---|---|
| 2,024,644 | 12/1935 | Hickman et al. | 96/60 |
| 3,093,052 | 6/1963 | Burner et al. | 96/63 |
| 3,264,970 | 8/1966 | Hersh | 354/314 |
| 3,477,356 | 11/1969 | Ray | 96/63 |

FOREIGN PATENTS OR APPLICATIONS

| | | | |
|---|---|---|---|
| 879,443 | 10/1961 | United Kingdom | 96/60 R |

OTHER PUBLICATIONS

Two Bath Rapid Stabilizaton Proc. No. 5583, vol. 114, Brit. Journal of Photography July 21, 1967, pp. 620–621, 625.

Townley, Photo Sci. & Eng., vol. 6, No. 1, Jan.–Feb. 1962 pp. 26–31.

Smith & Townley, J. Photo Sci. 7:55–59 (1959).

*Primary Examiner*—Mary F. Kelley

*Attorney, Agent, or Firm*—William J. Daniel

[57] ABSTRACT

A rapid process in not more than 60 seconds of an imagewise exposed photographic light sensitive film, comprising developing or activating, stabilizing, fixing, and washing.

8 Claims, No Drawings

METHOD OF PRODUCING PHOTOGRAPHIC IMAGES

This is a continuation, of Ser. No. 429,631, filed Dec. 28, 1973.

The present invention relates to a method of producing permanent photographic images in a rapid way.

The method of the present invention comprises the processing step of transporting automatically and at a substantially constant speed an image-wise exposed light-sensitive silver halide material in order through a developing or activating station, a stabilising station, a normal fixing and a rinsing station.

The successive stations for wetting the light-sensitive material are arranged in such a way that a constant transporting speed of the light-sensitive material the processing time amounts to front 1 to 15 seconds and preferably from 2 to 3 seconds for each of the processing liquids applied in the 4 successive processing stations. The processing time is the period of time elapsing from the begin of a processing step of the finish of this step i.e. when a stop-treatment or another processing step starts. This period of time mostly is somewhat longer than the real period of time during which the processing liquid is really applied, thus mostly longer than the actual wetting time. The total processing time is always comprised between 4 and 60 seconds, which is properly low, even with respect to the maximum processing time. The total processing time can even be reduced by applying generally known techniques for accelerating photographic treatments, e.g. by a rise of the temperature of at least one of the processing liquids, preferably of the developing or activator liquid and/or of the fixer. The method of the present invention possesses the advantage over the generally known two-bath rapid stabilisation process that it yields really permanent copies, which moreover, are not tacky. These advantages are clearly illustrated in a specific example. It is true that permanent and non-tacky copies can be obtained by fixing a developed photographic silver halide material in a normal fixing bath, but that fixing takes a rather long time, viz. at least about 1 minute. The method of the present invention possesses the advantage over this usual technique or providing permanent copies more rapidly. This advantage has to be ascribed to the insertion of a short treatment with a stabilising liquid between the development and the normal fixing steps. It was fully unexpected that the fixing time could be shortened considerably by a short preliminary treatment with a stabilising liquid. In the specific example further in the description the strong reduction of the fixing time obtained by processing according to the method of the present invention is illustrated. The same favourable effect could not be obtained by adding the stabilising agents to the normal fixing bath instead of applying them according to the method of the present invention to the light-sensitive material by a short pretreatment.

The light-sensitive material for use in carrying out the method of the present invention may be whatever type of light-sensitive silver halide sheet material, preferably of a rapidly developable type. The silver halide emulsion layer may be a silver chloride, a silver chloro-bromide, a silver chloro-iodide, a silver bromide or a silver bromo-iodide emulsion layer. Silver halide emulsions with a rather strong gradation for the reproduction of line work may be used as well as silver halide emulsions having a softer gradation and being suited for the reproduction of continuous tone originals. Silver halide emulsions of the type normally used for the registration of an X-ray pattern or a pattern of a radioactive radiation are suitable too. In carrying out the method of the present invention it may be advantageous for some applications to employ a silver halide emulsion layer of such a type that the contrast of the developed image depends on the wavelength of the light that is used for the image-wise exposure. For more particulars on silver halide emulsions of this type reference is made to the published Dutch Patent Application 6805450 filed Apr. 18, 1968 by Gevaert-Agfa N.V.

The silver halide emulsion layer, preferably being a gelatino silver halide emulsion layer, is applied to a common photographic support sheet, e.g. a paper support or a support of a preferably transparent hydrophobic synthetic polymeric material. Occasionally the support may be provided with one or more suitable subbing layer(s) for ensuring a good adherence of the light-sensitive silver halide emulsion layer to the support sheet. The light-sensitive material preferably comprises an amount of silver halide equivalent to from about 1 to about 20 g of silver nitrate per sq.m. The method of the present invention is especially suited for being carried out with a light-sensitive material having a hydrophobic synthetic film support. As a matter of fact, when such a material is processed according to the two-bath rapid stabilization method referred to above, a print with a very tacky surface is obtained, which is not suited for being used as an intermediate for making copies in contact. On the contrary, the print obtained by processing a same type of light-sensitive material according to the method of the present invention is not tacky and consequently it is especially suited as an intermediate for the production of contact copies.

The light-sensitive material may comprise one or more usual auxiliary layers such as an antihalation layer, an antistatic layer, a protective layer, etc. The light-sensitive material may further comprise any kind of usual ingredients and coating aids. Into the silver halide emulsion layer and/or in another water-permeable layer preferably one or more developing substances are incorporated, often together with a preservative for said developing substance(s). Developing substances that have proved to be especially suitable for the purpose of the present invention are hydroquinones and 3-pyrazolidinone developing compounds. These types of developing compounds are generally known in the art and thus need no further explanation. Preferably both types of developing compounds are incorporated into the light-sensitive material together. Mostly hydroquinone and/or an alkylated hydroquinone is applied in an amount of from about 200 mg to about 3 g per sq.m. and the 3-pyrazolidinone developing compound in an amount of from about 50 to about 400 mg per sq.m. The hydroquinone developing compound is mostly incorporated into the silver halide emulsion layer itself; the 3-pyrazolidinone developing substance preferably is incorporated into the silver halide emulsion layer and/or into a layer on top of the silver halide emulsion layer. Normally also preservatives for the developing substances present are incorporated into the light-sensitive material. As suitably preservatives may be mentioned water-soluble organic and inorganic bisulphites such as formaldehyde-bisulphite and potassium metabisulphite. It is a preferred embodiment of the method of the present invention to incorporate the total amount of developing substance(s) into the light-sensitive material. Other usual ingredients and coating aids for one or more water-permeable layers of the light-sensitive material are stabilizers (chemical and/or optical), hardeners, softening agents, development accelerators, preservatives, anti-staining agents, latices, dispersing agents, etc.

Depending on the kind of the original, of the ray pattern and of the light-sensitive material used, the image-wise exposure of the light-sensitive material can occur by transmitted light or in reflex, in contact or not, in a camera with lenses, outside of a camera by means of a common lamp or of a tube lamp or in a cassette provided with reinforcing screens. When the silver halide emulsion layer is of the type of which the contrast depends on the wavelength of the light used for the image-wise exposure (see the published Dutch Patent Application 6305450 filed Apr. 18, 1968 by Gevaert-Agfa N.V. referred to above), said wavelength can be chosen according to the kind of the original and of the desired contrast of the print. The exposure station may be coupled to the processing station but it may also be wholly separate therefrom.

According to the method of the present invention the image-wise exposed light-sensitive material is transported automatically and at a substantially constant speed for processing, e.g. by means of rollers and guideways. First it is transported through a developing or activating station. Such a station may consist of a tray containing the developing or activating liquid through which the light-sensitive material is transported, in other words the light-sensitive material may be wetted by dipping. The developing or activatng liquid can also be applid by means of a lick-roller taking up said liquid on its surface and applying it uniformly to the whole emulsion side of the light-sensitive material. The developing or activating liquid may also be comprised in a kind of bottle from which again and again an accurately measured amount is supplied to the light-sensitive material, e.g. by spraying or by uniform spreading. Further, the developing or activating liquid may be contained in a pod, which is embodied in the light-sensitive material or is applied hereto later on, and which at the development stage is ruptured, whereupon the content is uniformly spread over the part of the photographic material to be developed. The term developing or activation station thus is very board and encompasses any way of carrying out the development of the light-sensitive material, wherein the latter is transported automatically and at a substantially constant speed. Also the stabilising station as well as further treating stations have to be taken in their broad sense. For a detailed description of different suitable practical embodiments for these processing stations reference is made to the detailed description given hereabove with respect to the developing or activating station.

The developing liquid for use in carrying out the method of the present invention preferably is an energetic surface developer. The high energy is required in order to allow the development to proceed quickly and may be obtained by properly alkalizing the developing liquid (pH 10-12), and/or by using (a) high-energy developing substance(s) or a combination of developing substances, which as a consequence of their superadditive action is very energetic such as a combination of a hydroquinone and a 3-pyrazolidinone developing substance as already referred to above. The concentration of the alkaline substance(s) and developing substance(s) in the developing liquid is generally known in the art and need no further explanation. Suitable alkaline substances for the developing or activating liquid and sodium hydroxide, sodium carbonate, trisodium phosphate and rather strong organic alkaline substances. The developing or activating liquid further may comprise usual ingredients such as preservatives, compounds releasing halide ions, toning agents and thickeners, whereby a developing or activating paste may be obtained.

As already indicated above it is a preferred embodiment of the method of the present invention to incorporrate at least part and preferably even the total amount of developing substance(s) into the light-sensitive material. In this way the developer is reduced to a mere aqueous alkaline liquid which is substantially free from developing substance(s) and consequently is better keepable. Such an alkaline liquid is also called an activator.

The stabilising liquid is an aqueous liquid containing a suitable stabilising agent. By "stabilizing" agent any compound is understood that is capable of converting light-sensitive silver halide grains in substantially light-sensitive complexes, which are water-insoluble or substantially water-soluble, but in the latter case not completely and usually are not removed from the developed and stabilised silver halide emulsion layer by normal washing. Suitable stabilizing agents of the class that forms water-insoluble light-insensitive complexes with silver halide grains are compounds belonging to the general class of compounds represented by the general formula RSH, wherein R is any aliphatic, aromatic, or heterocyclic radical. Compounds o this class include thioglycolic acid, monothiohydroquinone, thiosalicylic acid etc. Suitable stabilizing agents that form substantially water-soluble complexes with silver halide are thiosemicarbazide, acetylthiourea, allylthiourea, sulphonated thioureas, sulphonated thiosemicarbazides and water-soluble thiocyantes. The water-soluble thiocyanates are the best suited compounds for the purpose of the present invention. Especially potassium and ammonium thiocyanate are very suitable. The stabilising solution is an aqueous solution comprising preferably of from about 20 to about 300 g of stabilising agent. Preferably this solution is slightly acidified. The stabilising solution may furthermore contain any usual ingredients such as a preservative for the image produced etc.

After its treatment in the stabilising station the light-sensitive material is treated in a normal fixing station. The treatment in a fixing station comprises a treatment with an aqueous fixer i.e. an aqueous solution of a compound forming with silver halide water-soluble complexes forms, which can be removed from a developed silver halide emulsion layer rather easily and completely by normal washing. Suitable fixing agents are the water-soluble thiosulphates especially ammonium thiosulphate and sodium thiosulphate. The fixing agent is mostly present in an amount of from 50 to 300 g per litre of fixer. Just as the stabilising solution the fixer in most cases i slightly acidic. It may comprise some further ingredients such as sulphites and bisulphites.

Finally the light-sensitive material is rinsed in order to eliminate the silver halide complexes formed. Mostly this is done by means of water, preferably common tap water to which a calcium-sequestering compound has been added, e.g., the trisodium salt of ethylenediaminetetraacetic acid, demineralised or distilled water which may contain coating aids. Rinsing can proceed according to any usual technique.

For the treatment in the various processing stations the image-wise exposed silver halide material is transported automatically and at a substantially constant rate. During this transport the successive processing steps are carried out. In addition to the four essential processing steps, other pretreatments, intermediate treatments or after-treatments may be applied in carrying out the method of the present invention. So a development-stopping treatment may be inserted. It is often advantageous to eliminate the surplus liquid in one or more of the processing steps, e.g. by means of a doctor knife or a pair of pressure rollers between which the light-sensitive material is led. After rinsing, the light-sensitive material may be dried yet, e.g. by means of a device blowing hot air, or by bringing the material in contact with a heated plate. In most cases, however, no additional treatments are carried out and the total processing remains limited to the essential processing steps. The four processing stations may be arranged separately but mostly are grouped in a compact unit wherein the light-sensitive material is automatically carried from one unit to another at a constant speed. Preferably the units just consist of a tray containing the liquid through which the light-sensitive material is transported.

The method of the present invention is a rapid processing system which is not substantially slower than the generally known two-bath rapid stabilisation processing. The copies obtained are completely permanent and in this respect are comparable to copies obtained by development, normal fixing and rinsing.

The method of the present invention is now illustrated by the following specific example.

EXAMPLE

To a cellulose triacetate film support provided in order with a gelatin-cellulose nitrate subbing layer and a gelatin layer a light-sensitive gelatin silver chlorobromide emulsion is applied. This emulsion has a gelatin silver nitrate ration of 0.75 and contains hydroquinone and 1-phenyl-3-pyrazolidinone. It is applied in such a way that per sq.m an amount of silver halide equivalent to 4.5 g of silver nitrate, 2 g of hydroquinone and 0.3 g of 1-phenyl-3-pyrazolidinone are present. On top of the silver halide emulsion layer a gelatin antistress layer is applied prorata of 1.5 g of gelatin per sq.m.

The light-sensitive material thus obtained is image-wise exposed to a line original and then in a compact automatic processing unit by means of driving and squeeging rollers covered with a resilient material and of guide ways is led at a constant speed in order through the following 4 processing liquids at room temperature:

| | |
|---|---|
| 1. an activator liquid: | |
| sodium hydroxide | 30 g |
| sodium sulphite | 50 g |
| potassium bromide | 2 g |
| water to make | 1000 ccs |
| 2. a stabilising liquid: | |
| ammonium thiocyanate | 250 g |
| sodium metabisulphite | 20 g |
| water to make | 1000 ccs |
| sulphuric acid in order to bring the pH to 4.5 | |
| 3. a fixer: | |
| sodium thiosulphate | 200 g |
| potassium metabisulphite | 25 g |
| water to make | 1000 ccs |

-continued

| |
|---|
| 4. a rinsing liquid consisting of demineralised water. |

The total time of processing is 16 seconds (i.e. 4 seconds for each of the mentioned 4 processing liquids).

The print obtained after this processing is of excellent quality and is not tacky. It is especially suited for being used as an intermediate for the production of contact prints.

A print obtained by treating a similar image-wise exposed light-sensitive material only in the two first processing liquids is tacky and is not particularly suited for making contact prints therefrom. Moreover, the permanence is poor as compared with that of the print obtained according to the method of the present invention as described above.

This appears clearly from the following table.

| Storage time of the print at 90 % of relative humidity | Maximum density of the print obtained by treatment in two processing liquids as described above | Maximum density of the print obtained by treatment in four processing liquids according to the present invention as described above |
|---|---|---|
| 0 | 4.00 | 4.00 |
| 12 h | 2.64 | 4.00 |
| 24 h | 1.98 | 4.00 |
| 48 h | 0.30 | 4.00 |

In order to produce a print of the same good permanence as that obtained according to the present invention and as illustrated above, but without having applied the 4 seconds treatment with the stabilising liquid, a treatment of about 60 sec. with the fixer is necessary, i.e. a 15-fold fixing time as compared with the fixing time applied according to the method of the present invention as described above.

Thus it has been shown clearly in this example that the method of the present invention offers incontestably important and unexpected advantages over a two-bath processing system (development, stabilisation) and over the usual processing wherein fixing directly follows the development.

I claim:

1. A process of forming a photographic image, wherein a photographic material comprising a supported light-sensitive silver halide layer is imagewise exposed and is then continuously advanced at substantially constant speed in successive order into and through four processing stations for treating said exposed material with the following baths in order: a developing bath comprising an aqueous developing or activating liquid for converting the exposed silver halide to metallic silver, a stabilizing bath comprising an aqueous solution containing about 20-300 g per liter of a water-soluble alkaline thiocyanate for converting undeveloped silver halide to a substantially light-insensitive complex, a fixing bath comprising an aqueous solution containing about 50-300 g per liter of a water-soluble alkaline thiosulfate for transforming unexposed silver halide into a water-soluble complex and a washing bath comprising water for removing water-soluble silver salts from said layer to produce a permanent quality print, each such station comprising a tray containing the corresponding bath through which the material is transported and each such bath being maintained at about room temperature, said material being advanced at a speed such that it is immersed in each such bath for a period of 1-15 seconds and the total processing time for all four such processing stations is not more than 60 seconds.

2. The process of claim 1 wherein said material comprises a light-sensitive silver halide emulsion on a flexible film support.

3. Method according to claim 1, wherein the light-sensitive material comprises an amount of silver halide equivalent to from about 1 to about 20 g of silver nitrate per sq.m.

4. Method according to claim 1, wherein the silver halide emulsion layer of the light-sensitive material is a rapidly developable silver halide emulsion layer.

5. Method according to claim 1, wherein the light-sensitive material comprises at least part of the developing substance(s).

6. Method according to claim 1, wherein the light-sensitive material comprises the total amount of developing substance(s) and wherein the developing liquid is an alkaline liquid that is substantially free from developing substance(s).

7. Method according to claim 5, wherein the developing substance(s) present in the light-sensitive material belong(s) to the class of the hydroquinone and the 3-pyrazolidinone developing substances.

8. Method according to claim 7, wherein the hydroquinone is present in an amount of from about 200 mg to about 3 g and the 3-pyrazolidinone developing substance in an amount of from about 50 to about 400 mg per sq.m of the light-sensitive material.

* * * * *